US006032823A

United States Patent [19]

Bacon

[11] Patent Number: 6,032,823

[45] Date of Patent: Mar. 7, 2000

[54] NON-ROUND EASY-GRIP COMPOSITE CONTAINER

[75] Inventor: John Ellis Bacon, Hartsville, S.C.

[73] Assignee: Sonoco Development, Inc., Hartsville, S.C.

[21] Appl. No.: 08/580,510

[22] Filed: Dec. 28, 1995

[51] Int. Cl.[7] ..... B65D 5/64

[52] U.S. Cl. ..... 220/620; 220/675; 229/4.5

[58] Field of Search ..... 220/620, 669, 220/675, 355, 356, 258; 229/4.5

[56] References Cited

U.S. PATENT DOCUMENTS

| | | | |
|---|---|---|---|
| 1,992,182 | 2/1935 | Buist | 229/4.5 |
| 2,301,754 | 11/1942 | Seiffert . | |
| 3,042,288 | 7/1962 | Carpenter, Sr. . | |
| 3,357,626 | 12/1967 | Carpenter et al. | 229/4.5 X |
| 3,659,585 | 5/1972 | Bay | 220/675 X |
| 3,756,493 | 9/1973 | Holmes . | |
| 3,892,351 | 7/1975 | Johnson et al. | 220/258 X |
| 4,157,762 | 6/1979 | Robinson | 220/669 |
| 4,303,190 | 12/1981 | Ditto et al. | 220/620 X |
| 5,101,990 | 4/1992 | Krishnakumar et al. | 220/675 X |
| 5,261,544 | 11/1993 | Weaver, Jr. | 220/675 X |
| 5,435,451 | 7/1995 | Dyer | 220/675 X |

FOREIGN PATENT DOCUMENTS

| | | |
|---|---|---|
| 5-49608 | 12/1991 | Japan . |
| 4-352636 | 12/1992 | Japan . |

*Primary Examiner*—Steven Pollard
*Attorney, Agent, or Firm*—Alston & Bird, LLP

[57] ABSTRACT

A non-round easy-grip composite container has a composite bottom closure and an outwardly-curled beaded top edge adapted to receive a membrane closure and a snap-on overcap. The composite container has outwardly-bowed curved front, rear and side walls and curved corners defining eight circular segments in transverse cross-section arranged symmetrically about perpendicular axes and at least some of which have different radii. Preferably, the container is of a combination rectangular and elliptical shape in transverse cross-section and the front and rear walls have a common predetermined radius in transverse cross-section which is larger than a common predetermined radius for the side walls in transverse cross-section. The corners also have a common predetermined radius in transverse cross-section.

15 Claims, 2 Drawing Sheets

NON-ROUND EASY-GRIP COMPOSITE CONTAINER

FIELD OF THE INVENTION

This invention relates to a non-round easy-grip composite container having a composite bottom closure and an open outwardly-curved beaded top edge adapted to receive a membrane closure and a snap-on overcap.

BACKGROUND OF THE INVENTION

Composite containers constructed of desired layers of material usually including a paper body layer, a liner layer and a label layer have heretofore been utilized for packaging food and other products including detergents, cleansers, baking powders, etc. These composite containers have included a composite bottom closure which can be made of the same materials as the container or a different combination of materials. These containers have been closed at the top by a variety of top closures including a membrane closure, which along with the bottom closure can preferably provide a hermetically sealed container, and an overcap. A preferred construction includes an outwardly curled beaded top edge on the composite container for receiving the membrane closure which is secured thereto by heat sealing, adhesive or the like, and a snap-on overcap which is adapted to fit over the outwardly-curled beaded top edge of the composite container.

Non-round containers, preferably of rectangular shape, are becoming desirable for packaging food and other products wherein significant "bill boarding" is desired for exposing additional areas of labeling on the outside walls of the containers when placed on a shelf or other retail display. Also these non-round (rectangular or square) containers allow more efficient placement in cartons for shipping and on retail shelves. However, it has been found difficult, if not impossible, to provide such non-round composite containers with the desired outwardly-curled beaded top edge due to the construction of such edge and the equipment conventionally utilized to form such edge, since these non-round (rectangular or square) containers have sharp corners which do not lend themselves to outwardly-curled beaded top edges.

OBJECT AND SUMMARY OF THE INVENTION

Therefore, it is the object of this invention to provide a non-round composite container having a composite bottom closure and an outwardly-curled beaded top edge which is adapted to receive a membrane closure and a snap-on overcap.

It has been found by this invention that this object may be accomplished by providing a composite container having outwardly-bowed curved front, rear and side walls and curved corners defining eight circular segments in transverse cross-section arranged symmetrically about perpendicular axes and at least some of which have different radii. Preferably, the composite container is of generally a combination rectangular and elliptical shape in transverse cross-section having major and minor axes wherein the front and rear walls have a common predetermined radius in transverse cross-section, the side walls have a common predetermined radius in transverse cross-section which is less than the radius of the front and rear walls, and the corners have a common predetermined radius in transverse cross-section. Preferably, the corner radius is of a predetermined size that is tangent to the curved front and rear walls and to the curved side walls. It is also preferable that the radius of said front and rear walls and the radius of the side walls are of predetermined sizes so as to not form a tangential or negative intersection.

With this construction, it has been surprisingly found that this shape, which is a combination rectangular and elliptical shape, provides an easy-grip which is not present with round containers or with rectangular or square containers. This easy-grip is provided by the bowed or curved walls and corners which easily fit into the curved palm of a hand of a user gripping such container. Also, this shape allows the use of conventional beading or curling equipment for forming the beaded top edge.

BRIEF DESCRIPTION OF THE DRAWINGS

Some of the objects and advantages of this invention having been stated, other objects and advantages will become evident from the following detailed description of a preferred embodiment of this invention when taken in conjunction with the accompanying drawings, in which.

DESCRIPTION OF PREFERRED EMBODIMENT OF THE INVENTION

Figure 1:
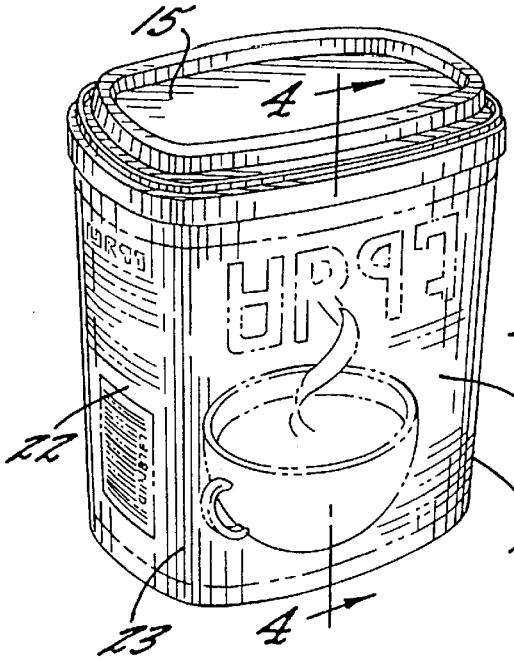
FIG. 1 is a perspective view of a non-round easy-grip composite container constructed in accordance with this invention.
Figure 2:
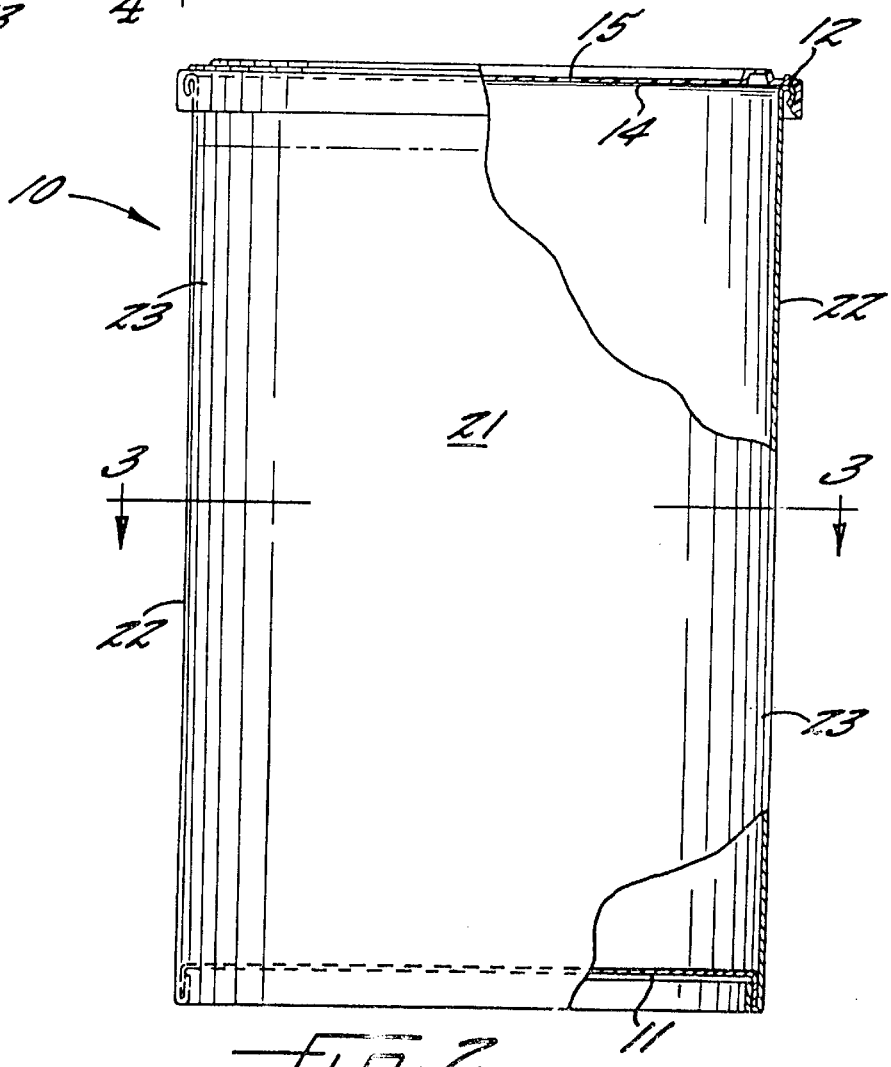
FIG. 2 is an enlarged front elevational view of the composite container of FIG. 1 with areas broken away and shown in section.

Referring now to the drawings, a preferred embodiment of a non-round easy-grip composite container, generally indicated at 10 is shown therein. This composite container 10, except for its shape, is of the well known type having a composite bottom closure 11 and an open outwardly curled beaded top edge 12 adapted to receive a membrane closure 14 and a snap-on overcap 15.

This composite container 10 may be convolutely wound, spirally wound or linearly drawn. The composite container 10 may be constructed of a plurality of layers which usually include a liner layer, a body or board layer and a label layer. The liner layers can be constructed of a polyethylene coated aluminum foil on a paper substrate, a polyethylene coated plastic film or metallicized film on a paper substrate, a plastic or metallicized film on a paper substrate, a hot melt adhesive sealable liner, etc. The body layer may comprise one or more plies of recycled or virgin paper. The label layer may be a paper layer, an aluminum foil laminated paper layer, a polyethylene coated paper layer, a plastic film layer, etc. The composite container 10 can also be constructed from a single wrap layer which may be a pre-laminated coated and printed board or body layer with a polyethylene sealing layer thereon.

The composite bottom closure 11 can be constructed of the same composite materials utilized for the container 10 or may be constructed of other materials. The bottom closure 11 may be generally cup-shaped and secured to the container 10 by an inwardly curled portion at the bottom of the container 10 and by heat sealing, adhesives or other desired means. The beaded top edge 12 on the container 10 may be formed by conventional beading or curling equipment, well known to those with ordinary skill in the art, to produce an outwardly curled beaded top edge. The membrane closure 14 may be constructed of any desired membrane materials including a composite material of a plastic film layer, an aluminum foil layer, an adhesive layer, a paper layer, etc. and may be secured to the beaded top edge 12 by heat sealing, adhesive or other desired means. The snap-on overcap 15 may be injection molded of low density, linear low density or high density polyethylene or it may be thermoformed from a variety of plastic film materials and may be of conventional construction utilizing a downwardly extending skirt having a configuration for snapping over and being secured around the beaded top edge 12 of the composite container 10. The resulting composite container 10 is suitable for packaging food and other products, as described above, and may be hermetically sealed.

In accordance with the present invention, the composite container 10 has outwardly-bowed curved front and rear walls 21 and side walls 22 and curved corners 23 defining eight circular segments in transverse cross-section arranged symmetrically about perpendicular axes A, B. At least some of said circular segments have different radii. The front and rear walls 21 have a common predetermined radius R1 in transverse cross-section, the side walls 22 have a common predetermined radius R2 in transverse cross-section and the corners 23 have a common predetermined radius R3 in transverse cross-section, as shown in FIG. 3.

Preferably, the composite container is generally of a combination rectangular and elliptical shape in transverse cross-section. A rectangular shape would generally be one having two long sides parallel to each other and two short sides that are parallel to each other and perpendicular to the long sides. An ellipse or approximate ellipse is a closed curve, bend or bow in the form of a symmetrical oval. A curve is a line having no straight parts or bend or a bend with no angles. Accordingly, as may be seen in FIG. 3, the combination rectangular and elliptical shape in cross-section is provided by the eight circular segments defining the transverse cross-section of the outwardly-bowed curved front, rear and side walls 21, 22 and curved corners 23 of the composite container 10. If the radii R1 and R2 were equal, the shape of the composite container in transverse cross-section would be generally square and elliptical which is also within the scope of the present invention.

Figure 3:
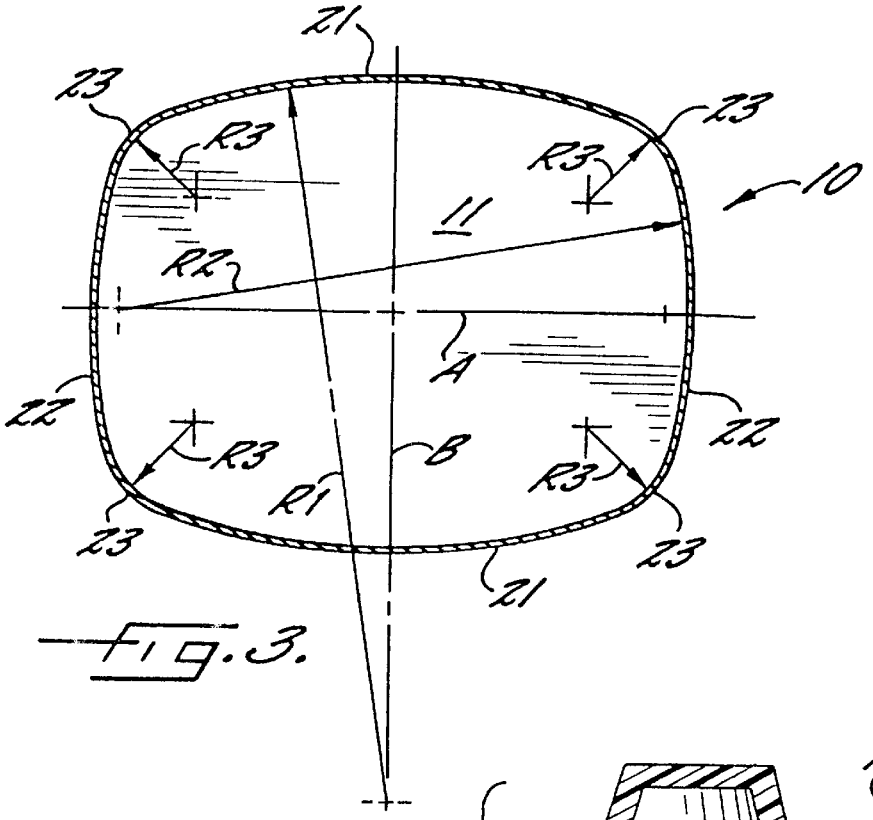
FIG. 3 is a sectional view, taken generally along the line 3—3 of FIG. 2, and showing the various radii utilized for forming the walls and corners of the container.
Figure 4:
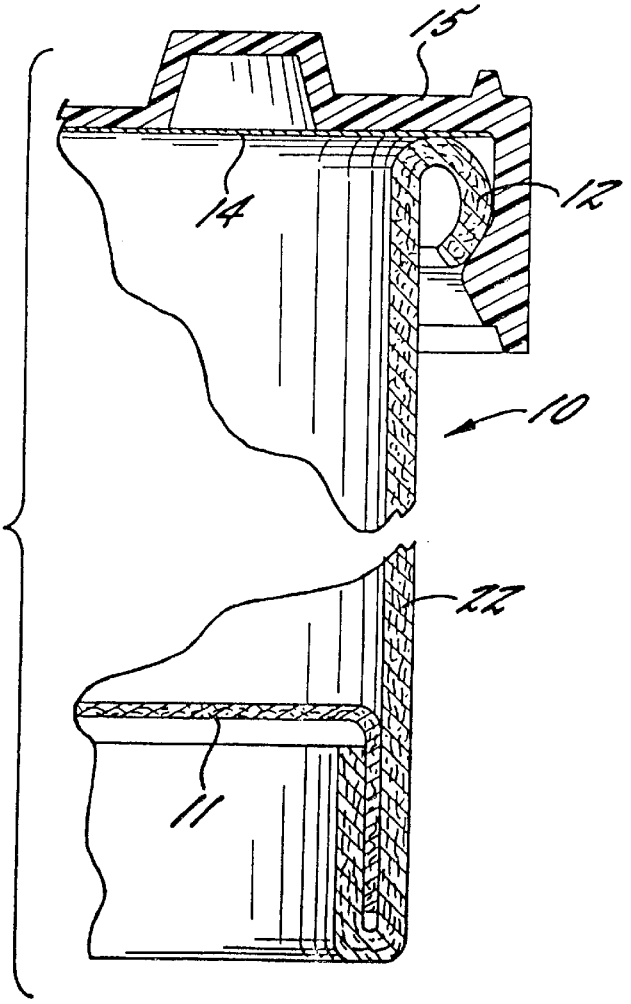
FIG. 4 is a partial sectional view, broken away, and taken generally along the line 4—4 of FIG. 1.

Preferably, as may be seen in FIG. 3, the corner radius R3 is of a predetermined size that is tangent to the curved front and rear walls 21 and to the curved side walls 22. It is also preferred that the radius R1 of the front and rear walls 21 and the radius R2 of the side walls 22 are of predetermined sizes so as to not form a tangential or negative intersection. An exemplary container of a standard inside volume could be constructed having a radius R1 of 6.50 inches, a radius R2 of 5.08 inches and a radius R3 of 0.79 inches. The length of the interior of the container along the major axes A would be 5.28 inches and the width of the inside of the container along the minor axes B would be 4.17 inches. The height of the inside of the container 10 (from the top of the bottom closure 11 to the bottom of the membrane 14) would be approximately 6.13 inches. This exemplary non-round easy-grip composite container 10 would have a interior volume of 119.2 cubic inches, which would be generally the same as a round or cylindrical container having an inside plug diameter 5.13 inches and an inside height of 6.13 inches.

Thus, this invention has provided a new construction and shape for a non-round composite container 10 having a composite bottom closure 11 which results in having an easy grip for a user of the container and which provides an outwardly-curled beaded top edge 12 adapted to receive a membrane closure 14 and a snap-on overcap 15 and wherein the outwardly-curved beaded top edge can be produced with conventional beading or curling equipment.

This invention has been described in considerable detail with reference to its preferred embodiment. However, variations and modifications can be made within the spirit and scope of the invention as described in the foregoing specification and as defined in the following claims.

What is claimed is:

1. A non round easy-grip composite container having a combination rectangular and elliptical shape in transverse cross-section and a composite bottom closure and sidewalls having a continuously arcuate, non-round open outwardly-curled beaded top edge adapted to receive a membrane closure and a snap-on overcap, said composite container having outwardly-bowed curved front, rear and side walls and curved corners defining eight circular segments in transverse cross-section arranged symmetrically about perpendicular axes and at least some of which have different radii whereby said curved sidewalls are easily gripped by a curved palm of a user.

2. A non-round easy-grip composite container, as defined in claim 1, wherein said front and rear walls have a common predetermined radius in transverse cross-section, said side walls have a common predetermined radius in transverse cross-section, and said corners have a common predetermined radius in transverse cross-section.

3. A non-round easy-grip composite container, as set forth in claim 2, wherein said radius of said front and rear walls is greater than said radius of said side walls.

4. A non-round easy-grip composite container, as set forth in claim 2, wherein said corner radius is of a predetermined size that is tangent to said curved front and rear walls and to said curved side walls.

5. A non-round easy-grip composite container, as set forth in claim 2, wherein said radius of said front and rear walls and said radius of said side walls are of predetermined sizes so as to not form a tangential intersection.

6. A non-round easy-grip composite container having a composite bottom closure and an open outwardly-curved beaded top edge adapted to receive a membrane closure and a snap-on overcap, said composite container being generally of a combination rectangular and elliptical shape in transverse cross-section having outwardly-bowed curved front, rear and side walls and curved corners defining eight circular segments in transverse cross-section arranged symmetrically about major and minor axes, said front and rear walls having a common predetermined radius in transverse cross-section, said side walls having a common predetermined radius in transverse cross-section which is less than said radius of said front and rear walls, said radius of said front and rear walls and said radius of said side walls being of predetermined sizes so as to not form a tangential intersection, and said corners having a common predetermined radius in transverse cross-section which is of a size that is tangent to said curved front and rear walls and to said curved side walls.

7. A non-round easy-grip compute container having a combination rectangular and elliptical shape in transverse cross-section and a composite bottom closure and sidewall having a continuously arcuate, non-round open outwardly-curled beaded top edge adapted to receive a membrane closure and a snap-on overcap, said composite container having outwardly bowed curved front, rear and side walls and curved corners defining eight circular segments in transverse cross-section arranged symmetrically about perpendicular axes and at least some of which have different radii whereby said curved sidewalls are easily gripped by a curved palm of a user and wherein said beaded top edge is formed subsequent to forming the container in said non-round shape.

8. A non-round easy-grip composite container, as defined in claim 7, wherein said front and rear walls have a common predetermined radius in transverse cross-section, said side walls have a common predetermined radius in transverse cross-section, and said corners have a common predetermined radius in transverse cross-section.

9. A non-round easy-grip composite container, as set forth in claim 8, wherein said radius of said front and rear walls is greater than said radius of said side walls.

10. A non-round easy-grip composite container, as set forth in claim 8, wherein said corner radius is of a predetermined size that is tangent to said curved front and rear walls and to said curved side walls.

11. A non-round easy-grip composite container, as set forth in claim 8, wherein said radius of said front and rear walls and said radius of said side walls are of predetermined sizes so as to not form a tangential intersection.

12. A method of forming a non-round easy-grip composite container comprising the steps of:

forming said composite container in a configuration having a combination rectangular and elliptical shape in transverse cross-section, the container having sidewalls which are continuously arcuate so as to define a non-round open top edge adapted to receive a membrane closure and a snap-on overcap, said composite container being formed so as to include outwardly-bowed curved front, rear and side walls and curved corners defining eight circular segments in transverse cross-section arranged symmetrically about perpendicular axes and at least some of which have different radii whereby said curved sidewalls are easily gripped by a curved palm of a user; and shaping said open top edge having said combination rectangular and elliptical shape in transverse cross-section to define an outwardly-curled beaded top edge.

13. A method according to claim 12 further comprising the step of applying a composite bottom closure to said composite container.

14. A non-round easy-grip composite container having a combination rectangular and elliptical shape in transverse cross-section and a bottom closure and sidewalls having a continuously arcuate, non-round open outwardly-curled beaded top edge wherein said beaded top edge is substantially continuous, said composite container having outwardly-bowed curved front, rear, and side walls and curved corners defining eight circular segments in transverse cross-section arranged symmetrically about perpendicular axes and at least some of which have different radii.

15. A non-round easy-grip container according to claim 14 wherein said beaded top edge is adapted to receive a membrane closure and a snap-on overcap.

* * * * *

UNITED STATES PATENT AND TRADEMARK OFFICE
CERTIFICATE OF CORRECTION

PATENT NO. : 6,032,823

DATED : March 7, 2000

INVENTOR(S) : Bacon

It is certified that error appears in the above-identified patent and that said Letters Patent is hereby corrected as shown below:

Title page, [56] References Cited, U.S. PATENT DOCUMENTS, insert the following:

--5,752,646 5/1998 Sandstrom--.

Title page, [56] References Cited, FOREIGN PATENT DOCUMENTS, insert the following:

--WO95/32126 11/1995 PCT--.

Column 4, line 60, "sidewall" should read --sidewalls--.

Signed and Sealed this

Twenty-sixth Day of December, 2000

*Attest:*

Q. TODD DICKINSON

*Attesting Officer*

*Director of Patents and Trademarks*